US008941447B2

(12) United States Patent
Johnson

(10) Patent No.: US 8,941,447 B2
(45) Date of Patent: Jan. 27, 2015

(54) MICROWAVE PULSE POWER SWITCHING SYSTEM

(76) Inventor: Ray M. Johnson, Shady Cove, OR (US)

( * ) Notice: Subject to any disclaimer, the term of this patent is extended or adjusted under 35 U.S.C. 154(b) by 306 days.

(21) Appl. No.: 13/335,728

(22) Filed: Dec. 22, 2011

(65) Prior Publication Data

US 2012/0161895 A1 Jun. 28, 2012

Related U.S. Application Data

(60) Provisional application No. 61/426,465, filed on Dec. 22, 2010.

(51) Int. Cl.

| | |
|---|---|
| ***H01P 1/11*** | (2006.01) |
| ***H01P 5/19*** | (2006.01) |
| ***H01P 1/39*** | (2006.01) |
| ***H01P 1/12*** | (2006.01) |

(52) U.S. Cl.

CPC .. *H01P 1/11* (2013.01); *H01P 1/39* (2013.01); *H01P 1/122* (2013.01); *H01P 5/19* (2013.01)

USPC ..... 333/20; 333/24.2

(58) Field of Classification Search

USPC ..... 333/20

See application file for complete search history.

(56) References Cited

U.S. PATENT DOCUMENTS

| | | | | |
|---|---|---|---|---|
| 2,805,415 | A | 9/1957 | Berkowitz | |
| 2,973,486 | A * | 2/1961 | Salzberg | 333/122 |
| 3,042,882 | A | 7/1962 | Jamison et al. | |
| 3,214,711 | A * | 10/1965 | Lyon et al. | 333/102 |
| 4,820,009 | A | 4/1989 | Thaniyavarn | |
| 5,257,872 | A | 11/1993 | Morgen et al. | |
| 6,407,646 | B1 | 6/2002 | Johnson | |
| 2008/0074220 | A1 * | 3/2008 | Guenther | 335/297 |

* cited by examiner

*Primary Examiner* — Stephen Jones
*Assistant Examiner* — Scott S Outten
(74) *Attorney, Agent, or Firm* — Beeson Skinner Beverly, LLP

(57) ABSTRACT

A microwave pulse power switching system includes a waveguide switching section having stacked reduced height waveguides, wherein microwave pulse power introduced into a first port of the waveguide switching section is divided between and propagates through the stacked reduced height waveguides. At least one and preferably both of the stacked reduced height waveguides of said waveguide switching section are loaded with a non-reciprocal ferrite material. A magnetic field switching circuit, which can include electromagnets and a bifurcating web plate of the waveguide switching section, produces a switchable static magnetic field in the ferrite loaded reduced height waveguides. Actuation of the magnetic field switching circuit will cause pulse power that emerges from the second port of the waveguide switching section to be changed or "switched" relative to the pulse power introduced into the first port of the waveguide switching section.

20 Claims, 11 Drawing Sheets

MICROWAVE PULSE POWER SWITCHING SYSTEM

CROSS-REFERENCE TO RELATED APPLICATIONS

This application claims the benefit of U.S. provisional patent application No. 61/426,465 filed Dec. 22, 2010.

BACKGROUND OF THE INVENTION

The present invention generally relates to high power waveguide systems, and more particularly to waveguide systems for delivering microwave pulse power to a load. The invention is directed to a waveguide system for controlling the pulse power output of microwave generators, especially self excited oscillators. The invention can be advantageously used with magnetrons, which only behave reasonably well over a limited power level range.

A magnetron produces an output of short pulses of high power microwave energy as a result of very short pulses of applied voltage. For some applications, it is desirable to deliver pulse power to a load, wherein the power magnitude for consecutive pulses varies from one pulse to the next, such as alternating between a pulse at full peak power to a pulse of attenuated power, e.g. one-half power (or less). Heretofore, it generally has not been practical to use magnetrons in such applications. The problem with using magnetrons in such applications is that magnetrons do not behave well when their applied voltage is varied from pulse to pulse.

The present invention provides a new microwave pulse power switching system (sometimes referred to herein as a "switcher" or "waveguide switcher") that permits self-excited oscillators, such as magnetrons, to be used in applications where it is desired to deliver to a load high power microwave pulses that differ in magnitudes from one pulse to the next. The invention overcomes the inherent limitations of such self-excited oscillators, which prevent them from being used in such applications.

SUMMARY OF INVENTION

The present invention is directed to a microwave pulse power switching system comprised of a waveguide switching section having a first port and a second port. The waveguide switching section has stacked reduced height waveguides, wherein microwave pulse power introduced into a first port of the waveguide switching section is divided between and propagates through the stacked reduced height waveguides of the switching section. At least one and preferably both of the reduced height waveguides of the waveguide switching section is loaded with a non-reciprocal ferrite material.

In accordance with the invention, a magnetic field switching circuit is provided for producing a switchable static magnetic field in the at least one ferrite loaded reduced height waveguide of the waveguide switching section. The magnetic field switching circuit is configured such that the static magnetic field produced thereby passes through the ferrite material contained in the switching section's ferrite loaded reduced height waveguide or waveguides. By using the magnet field switching circuit to switch the magnetic field passing through the ferrite material, the phase relationship between the divided microwave pulse power that propagates down the reduced height waveguides can be changed. Because of this resulting relative phase change in the divided pulse power, the total pulse power that emerges from the second port of the waveguide switching section can be changed by simply actuating the magnetic switching circuit. In particular, the magnetic switching circuit can be actuated to reduce the pulse power that emerges from the waveguide switching section relative to the pulse power introduced to the waveguide switching section, including switching the power output of the waveguide switching section to a substantially off condition.

The magnetic switching circuit of the invention can include switchable electromagnets positioned to provide a switchable magnetic field that passes through the ferrite material in the stacked reduced height waveguide or waveguides of the waveguide switching section. Each electromagnet can include a magnetic circuit block, preferably a laminated circuit block, for providing a desired magnetic circuit path to the sides of the waveguide switching section.

The switching system of the invention can be implemented as a two-port device or a multiport device. For example, three and four port switching systems in accordance with the invention are disclosed which use folded E-plane hybrid-Ts coupled to one or both ports of the waveguide switching section via a waveguide step transformer. Pulse power can be introduce to the switching system by a self-excited oscillator such as a magnetron.

Other aspects and advantages of the invention will be apparent from the detailed description of the illustrated embodiments proved below.

DETAILED DESCRIPTION OF THE ILLUSTRATED EMBODIMENTS

Figure 1:
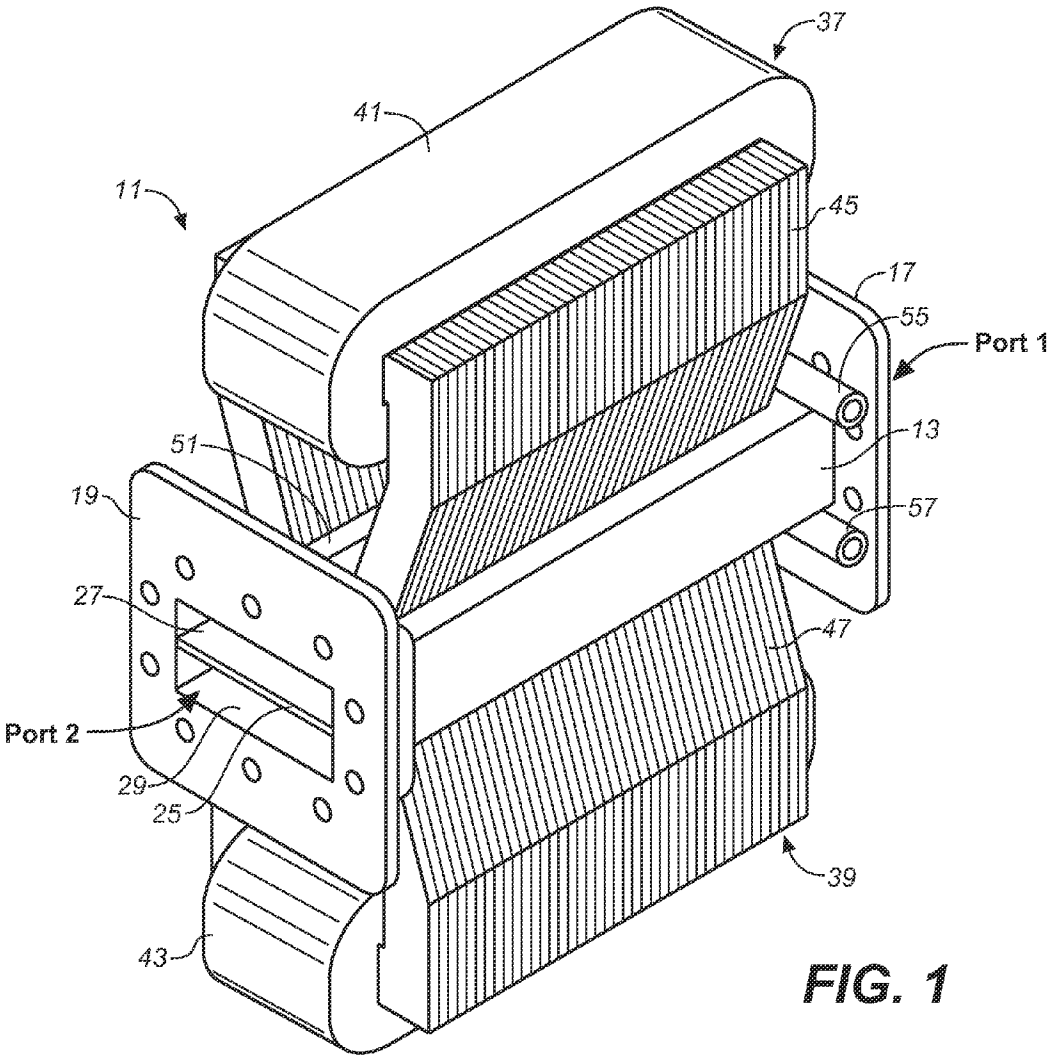
FIG. 1 is a top perspective view of a two-port version of a microwave pulse power switching system in accordance with the invention.
Figure 2:
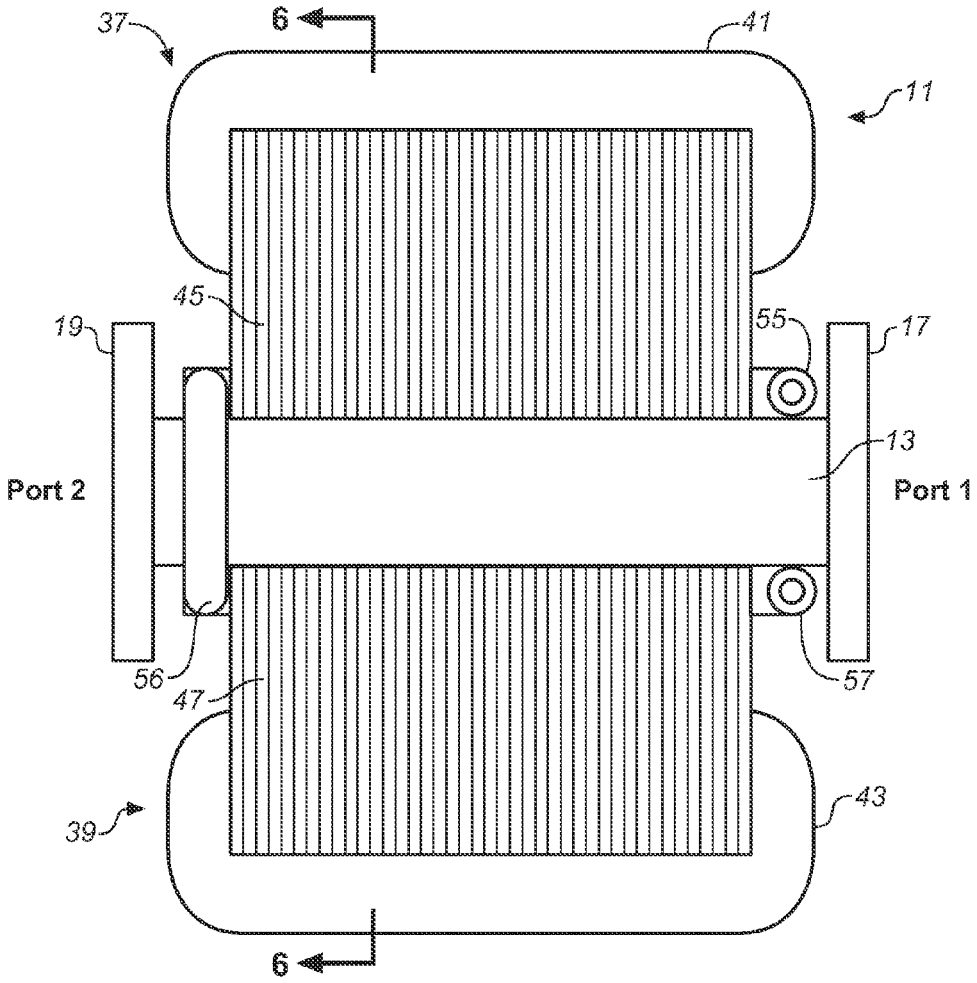
FIG. 2 is a side elevational view thereof.
Figure 3:
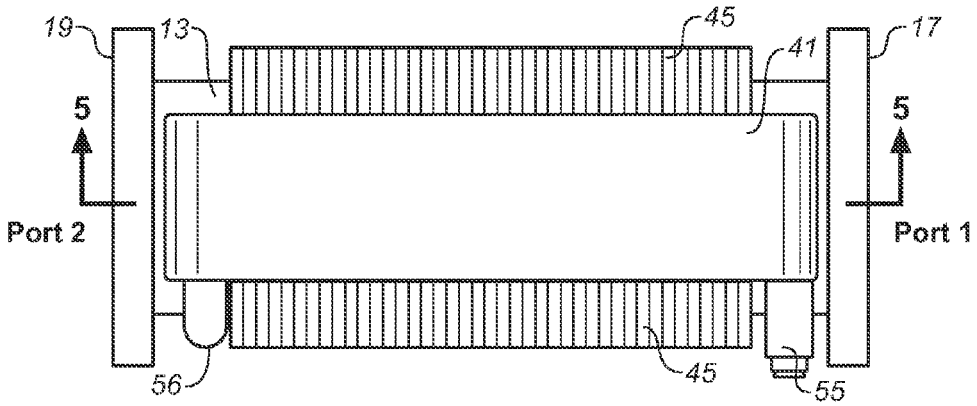
FIG. 3 is a top plan view thereof.

Referring now to the drawings, FIGS. 1-7 disclose a first embodiment of a microwave pulse power switching system in accordance with the invention, sometimes referred to herein as a two-port waveguide pulse power switcher, or simply a two-port switcher or device. The two-port switcher 11 includes a straight bifurcated waveguide switching section 13 having two ports, identified as Port 1 and Port 2. In a typical application, a microwave power source (not shown) is attached to Port 1 for introducing microwave power into the bifurcated waveguide switching section. As above-mentioned this power source would suitably be a magnetron. The microwave pulse power introduced at Port 1 is propagated through the bifurcated waveguide as hereinafter described until it arrives at Port 2 of the switcher. The modified pulse power is delivered to a load, such as a linear accelerator, from Port 2. Reflected power from the microwave load is, in turn, propagated back through the waveguide switching section.

Figure 5:
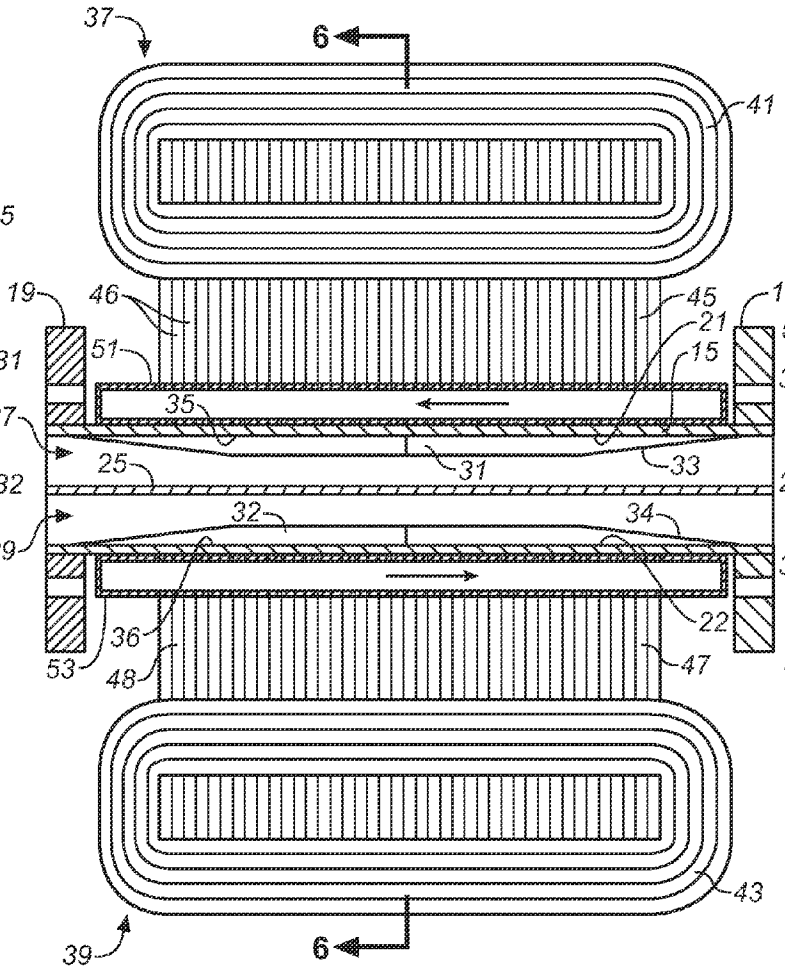
FIG. 5 is a cross-sectional view thereof taken along lines 5-5 in FIG. 4.

Referring to FIGS. 1-6, it can be seen that the bifurcated waveguide switching section 13 includes a section of waveguide 15 terminated by waveguide flanges 17, 19. In the illustrated embodiment, the waveguide 15 is a standard size full height rectangular waveguide, for example WR284 waveguide, that operates in a TE10 mode. The rectangular waveguide has upper and lower broadwalls 21, 22 and side walls 23 and is bifurcated by a longitudinally extending transverse web plate 25, which runs parallel to the broadwalls and which divides the waveguide switching section into stacked reduced height rectangular waveguides 27, 29. The height of each of these stacked reduced height guides is approximately one-half the full height guide size for the bifurcated section (one half the full guide height less one half the thickness of the web plate). As best shown in FIG. 5, the web plate 25 of the bifurcated waveguide switching section 13 preferably extends the full length of the waveguide.

Figure 6:
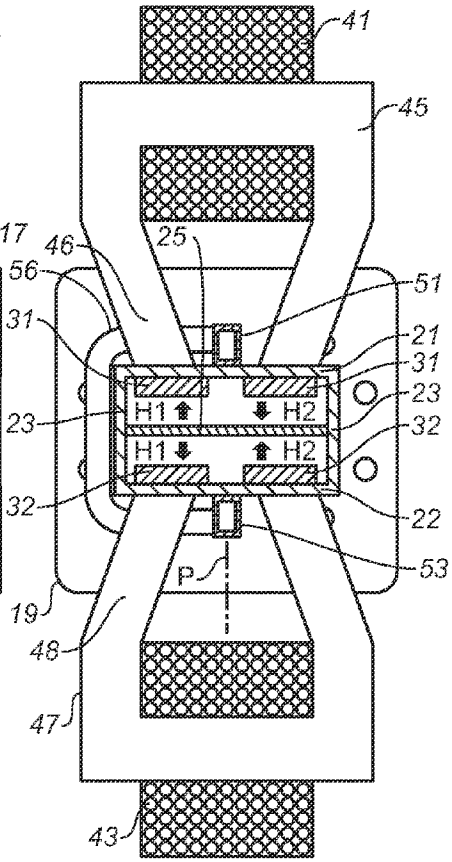
FIG. 6 is another cross-sectional view thereof taken along lines 6-6 in FIG. 5.

Referring to FIGS. 5 and 6, each of the reduced height waveguides 27, 29 of the bifurcated waveguide switching section 13 is loaded with a non-reciprocal ferromagnetic ("ferrite") material, such as nickel ferrite or garnet, in the form of ferrite strips 31 & 32, which are attached, such as with suitably bonding material, to inner conductive surfaces 35, 36 of the guide's outer broadwalls 21, 22. In each of the reduced height guides, the ferrite strips are arranged in pairs positioned symmetrically about the guide's vertical center plane P. Placement of the ferrite strips relative to the center plane P will affect the degree of phase shift achieved in the bifurcated waveguide switching section. Greater phase shift can be achieved by placing the ferrite strips slightly closer to the guide's side walls 23 than to the center plane.

Figure 4:
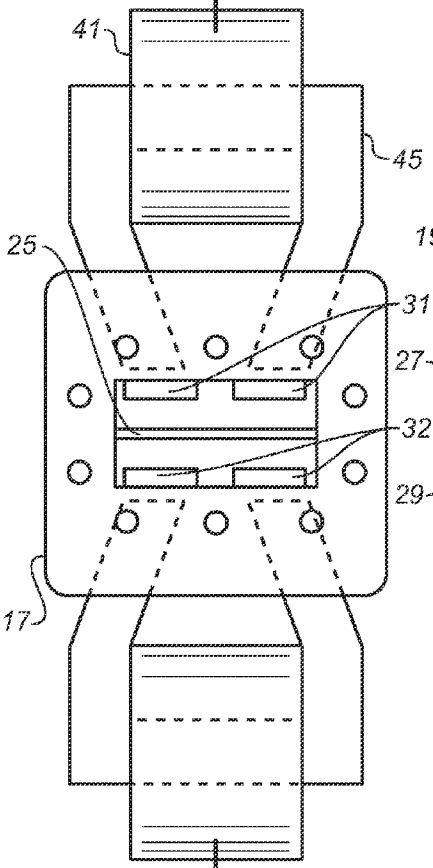
FIG. 4 is an end elevational view thereof.
Figure 7:
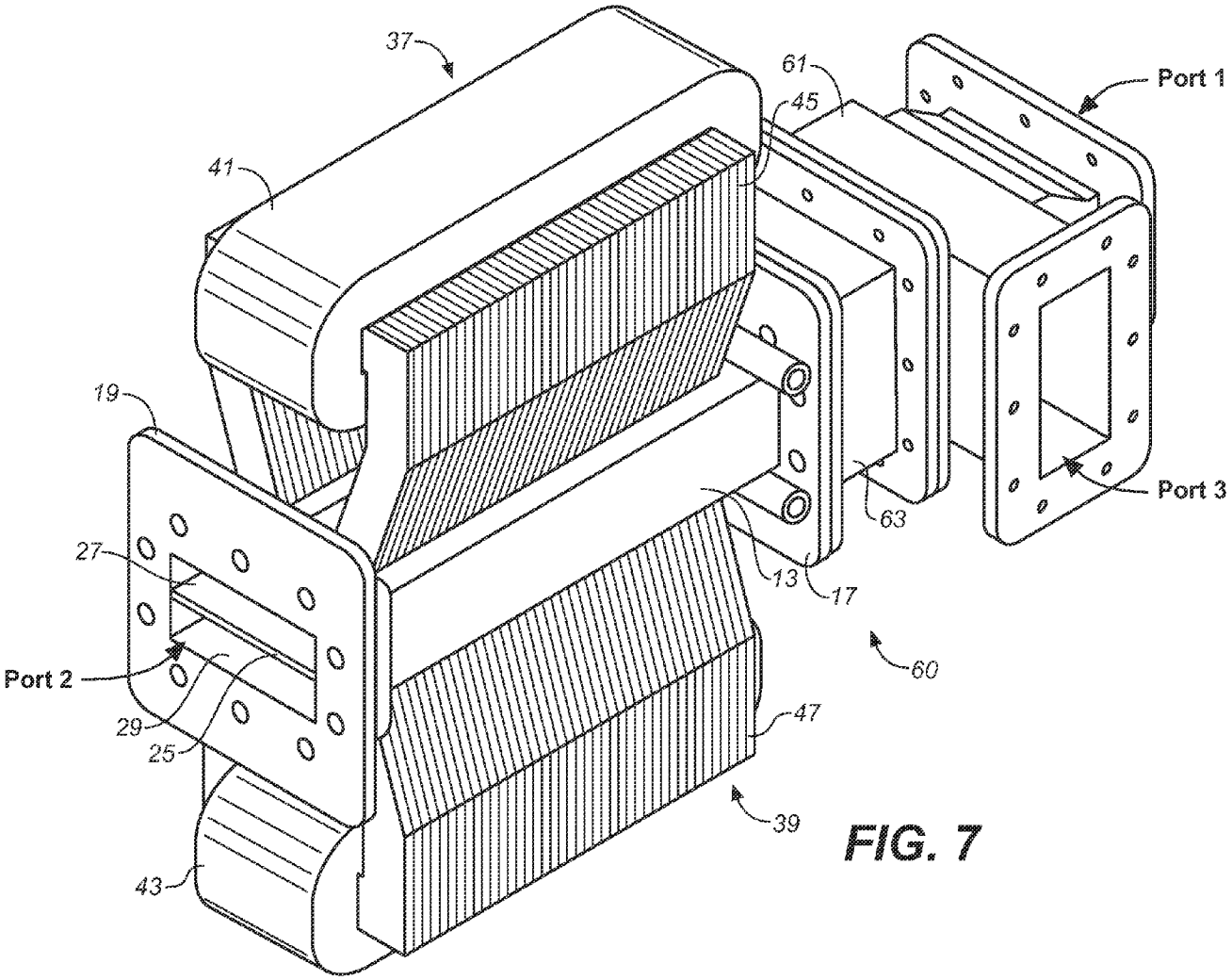
FIG. 7 is a top perspective view of a three-port version of a microwave pulse power switching system in accordance with the invention.
Figure 8:
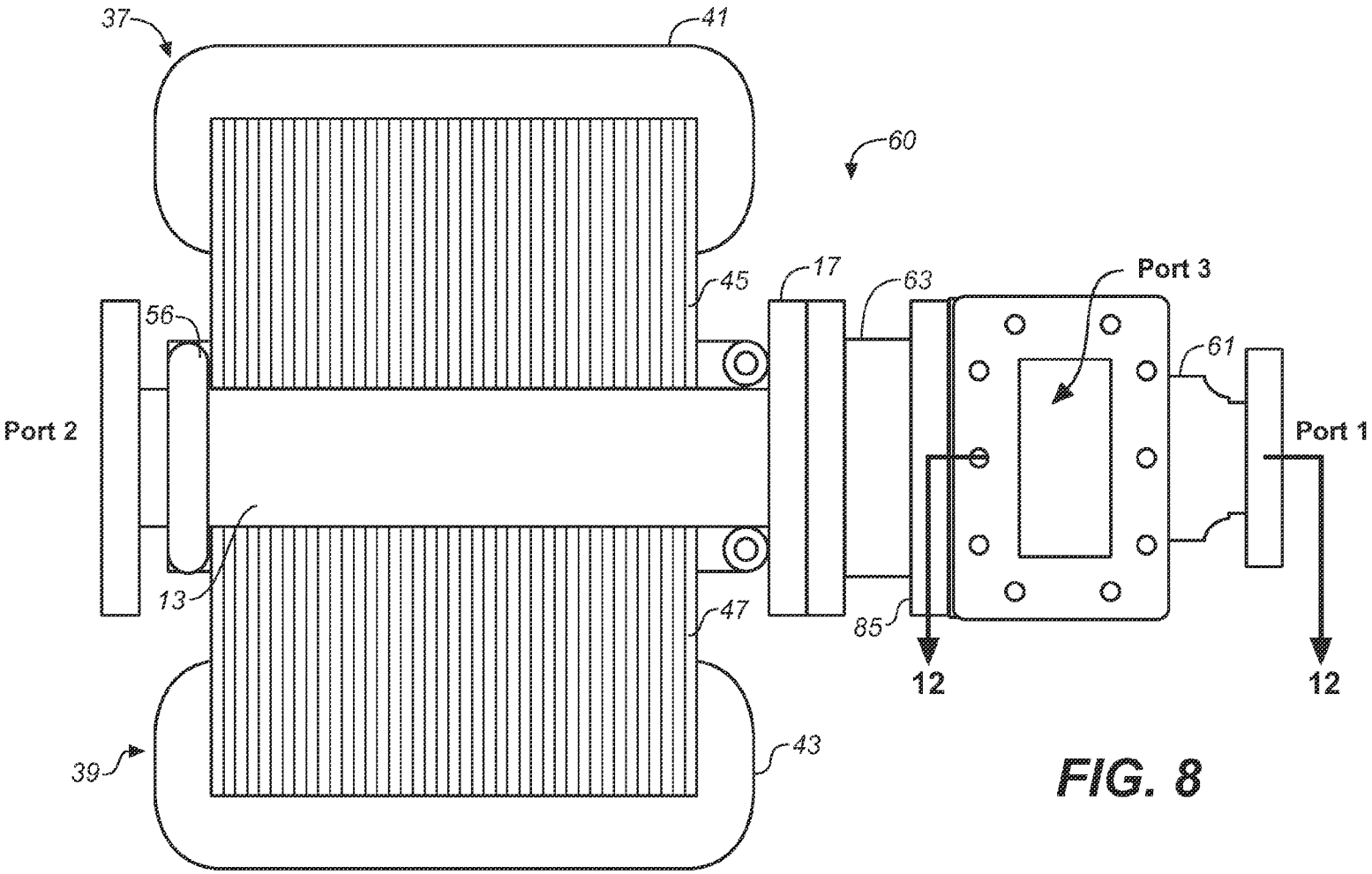
FIG. 8 is a side elevational view thereof.
Figure 9:
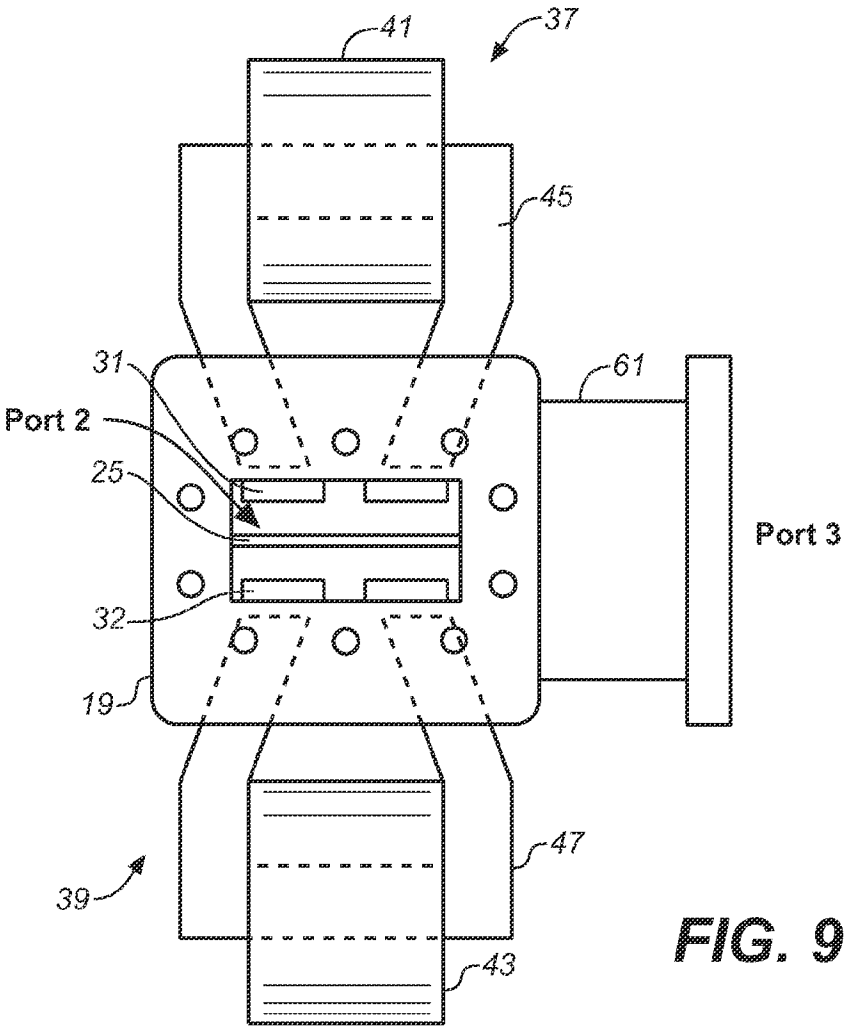
FIG. 9 is an end elevational view thereof.
Figure 10:
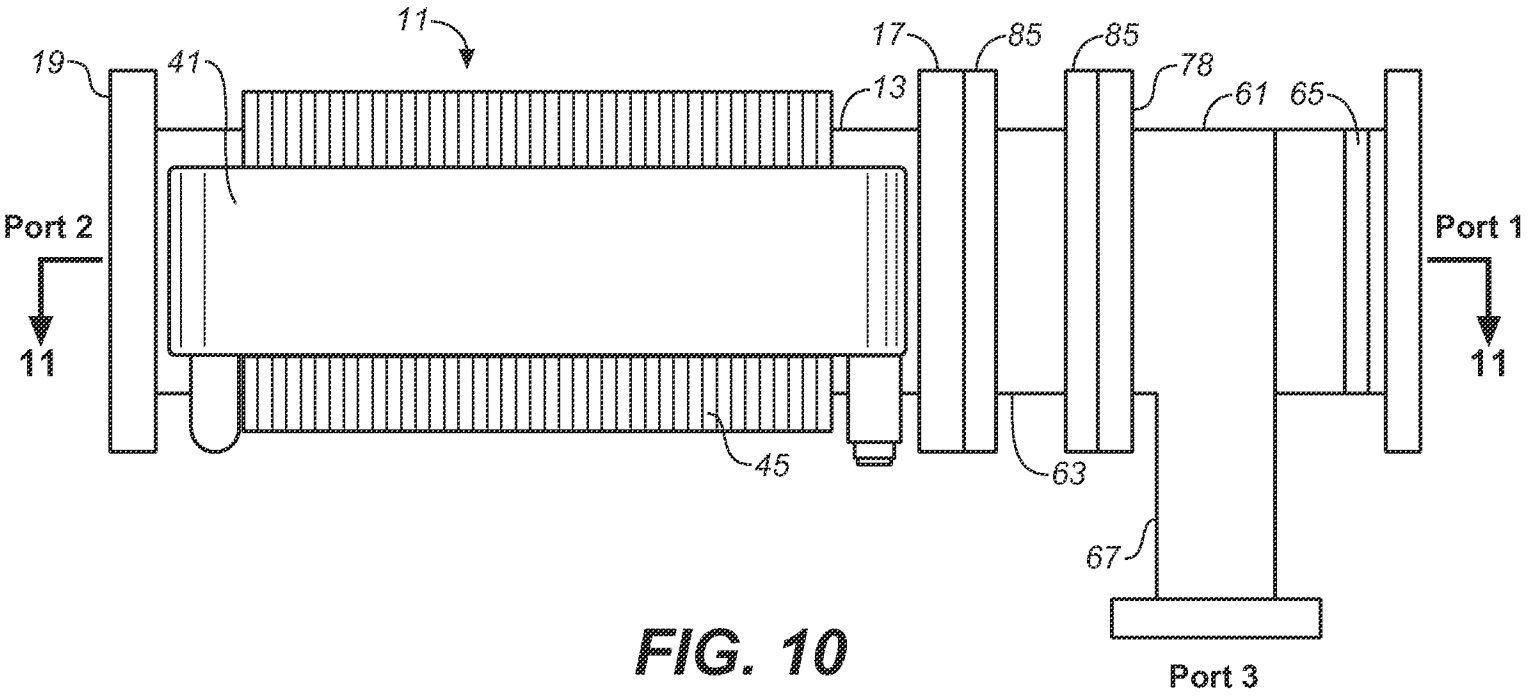
FIG. 10 is a top plan view thereof.

As best seen in FIGS. 4 and 5, the bifurcated ferrite loaded waveguide switching section 13 is preferably symmetric, not only about bisecting center plane P, but about all longitudinal mid-planes of the waveguide switching section. Thus, either Port 1 or Port 2 can act as the input to the switcher 11, with Port 2 or Port 1 acting as the output.

In accordance with the invention, pulse power introduced into Port 1 or Port 2 of the ferrite loaded waveguide switching section 13 can be "switched" from full power pulses to reduced power pulses as the pulses emerge from the opposite port. The pulse power at the output port can be so greatly attenuated in relation to the pulse power introduced into the waveguide switching section that the pulse power introduced to the waveguide switching section is effectively "turned off" In other possible modes of operation, switching causes reduced power pulses to emerge from the output port, for example, half power pulses that are −3 db down from the input.

The switching of the pulse power transmitted through the bifurcated waveguide switching section 13 is uniquely achieved by taking advantage of the ability of the non-reciprocal ferrite strips 31, 33 in the reduced height waveguides 27, 29 of the waveguide switching section to advance and retard the phase of microwave fields in the respective reduced height guides when a "static" magnetic field is passed through the ferrite strips. In accordance with the invention, switchable magnetic fields are supplied to the waveguide switching section by means of a switchable magnetic field circuit that can include two switchable electromagnets 37, 39, one positioned over each of the broadwalls 21, 22 of waveguide switching section 13. Each switchable electromagnet is comprised of at least one coil 41, 43 wrapped around a magnetic circuit block 45, 47, which extend to the waveguide's broadwalls. Each magnetic circuit block 45, 47 is preferably a horseshoe shaped laminated block formed by a stack of thin horseshoe shaped plates made of a material having high magnetic permeability, such as steel. (The laminated structure of the horseshoe shaped magnetic circuit blocks reduces eddy currents in the blocks.)

The two electromagnets of the magnetic field switching circuit have extended arms (such as arms designated 46, 48 in FIG. 6) which can be secured in position against the broadwalls 21, 22 of the bifurcated waveguide switching section by any suitable mechanical means (not shown), such as non-metallic straps wrapped circumferentially around the assemblies, or by bars such as non-conductive fiber glass bars secured longitudinally across the tops of the assemblies and attached to the guide's waveguide flanges 17, 19, or by adhesive means such as by an epoxy. A combination of mechanical means and adhesive means could be used to achieve such securement.

The electromagnets 37, 39 of the magnetic field switching circuit produce switchable static magnetic fields in the reduced height waveguides at a given point of time. These static magnetic fields are shown by magnetic field direction arrows H1 and H2 in FIG. 6, and result in oppositely directed magnetic fields within the reduced height guides 27, 29. The magnetic circuit is completed by the central web plate 25 that bifurcates the waveguide 15, and that forms a part of the magnet field switching circuit. This plate is suitably fabricated of steel for high magnetic permeability, which is copper plated to provide a conductive surface. In a WR284 waveguide size, the copper plated steel web plate can suitably have a thickness of approximately 0.1 inches.

It can further be seen that the elongated magnetic circuit blocks 45, 47 can be suitably sized to extend along the waveguide's broadwalls over most of the length of the ferrite strips 31, 32 that are located inside the guide. This sizing of the magnetic circuit blocks will provide a static transverse magnetic field through the length of the upper and lower reduced height waveguides of the waveguide switching section, and hence through the ferrite strips substantially over the entirety of their length.

In the ideal design, the magnetic field as shown by field arrows H1 and H2 in FIG. 6 are oriented in a perfectly transverse direction between web plate 25 and plates and the ends of the magnet circuit blocks 45, 47, to provide perfectly transverse static fields across the breath of each of the ferrite strips. However, in reality, some fringing will occur toward the edges of the ferrite strips and the bottom ends of the arms of the horseshoe shaped magnet circuit blocks. Such fringing effects can be minimized by maintaining adequate separation between the ferrite strips to either side of the guide center. Also, as best seen in FIG. 5, the ferrite strips 31, 32 preferably have tapered ends 33, 34 to provide matching from the two ends of the bifurcated guide.

The two-port waveguide pulse power switcher shown in FIGS. 1-6 operates to switch microwave pulse power introduced into Port 1 of the waveguide switching section 13 from full power to a reduced power level, or substantially completely off, by switching or varying the amount of static magnetic flux supplied to the bifurcated waveguide 13 and thus to the ferrite strips via the magnetic field switching circuit. As hereinafter further described, switching or varying the static magnetic flux is achieved by the actuation of the magnetic field switching circuit. The magnetic field switching circuit is actuated by switching or varying the current passed through the coils 41, 43 of electromagnets 37, 39. If there is no current in the coils, there will be zero "static" magnet fields in the bifurcated guide. If microwave power is fed into Port 1 with zero "static" magnet fields, then the top reduced height waveguide 27 of the bifurcated waveguide section 13 will have the same magnitude and phase shift as the bottom reduced height guide when the microwave power arrives at the output Port 2. (The mismatch at this output will be small.) The combined VSWR, at the designed frequency, for example in an S-band waveguide, is typically on the order of 1.1 or less. The insertion loss will typically be less than 0.4 db. Thus, without "static" magnetic field, this two-port device acts as a section of waveguide with minimal insertion loss.

If, however, current is passed through coils 41, 43, a static magnetic field H1, H2 will be produced in the stacked reduced height waveguides 27, 29 of the bifurcated waveguide switching section 13, causing a change in the phase relationship between the microwave power transmitted through the upper reduced height guide 27 and the microwave power transmitted through lower reduced height guide 29 (the magnitudes will remain the same). The difference in phase increases as the static magnetic field strength in the reduced height guides is increased. Thus, the difference in the phase relationship between the microwave power transmitted through the upper and lower reduced height waveguides 27, 29 can be increased by increasing the current in coils of the electromagnets of the magnetic field switching circuit.

The effect of changing the phase relationship between the microwave power in the upper and lower reduced height guides of the bifurcated waveguide switching section 13 is to change the total amount of power emerging from Port 2 of the bifurcated guide. For equal height upper and lower waveguides, the microwave power is divided equally between the two stacked guides. The power in each reduced height guide arriving at Port 2 can be vector analyzed into in-phase (zero degree) and out-of-phase (180 degree) vector components. The output power at Port 2 will be the sum of the in-phase components of the power arriving at this Port from the upper and lower reduced height guides; these in-phase components will couple into a full height waveguide (not shown) attached to Port 2 and be propagated as transmitted power. The out-of-phase components on the other hand will not be transmitted. In attempting to couple into the full size guide, the out-of-phase component in the top guide exactly cancels the out-of-phase component in the bottom guide. Thus, the out-of-phase components will not couple to the attached full height waveguide, but rather will be reflected.

As an example, if the switched-on electromagnets 37, 39 of the magnetic field switching circuit produce a total 90 degree phase difference at Port 2 between the microwave power in upper and lower reduced height guides 27, 29 (i.e.: 45 degree advanced in one guide and 45 degree retarded in the other), the output power transmitted from Port 2 will be 50% of the power introduce to Port 1, ignoring insertion loss. The other 50% will be reflected back toward Port 1. When it arrives at Port 1, the reflected power in each of the bifurcated guide sections will go through a similar relative phase shift, producing an additional 90 degrees difference at Port 1. Thus, only a small portion of the power arriving at Port 1 will be transmitted from this port; the rest reflects back to Port 2, and so on. In the two port configuration power will be lost within the waveguide 15 of the waveguide switching section 13 due to this low Q resonance.

The following results have been measured with a network analyzer for a straight two-port microwave pulse power switching system as above-described using WR284 waveguide driven by an oscillator at 3.0 GHz in the presence of the indicated static magnetic field conditions in the upper and lower stacked reduced height waveguides of the bifurcated waveguide switching section:

| Magnetic Field (gauss) | 0 | ≈215 | ≈440 |
|---|---|---|---|
| $S_{11}$ (SWR) | 1.08 | 4.20 | 15.9 |
| $S_{12}$ (db) | −0.36 | −4.29 | −11.4 |
| $S_{21}$ (db) | −0.39 | −4.44 | −11.9 |
| $S_{22}$ (SWR) | 1.06 | 4.04 | 15.3 |

For a nominal 215 gauss static magnetic field, the reflected power at Port 1 is 37.9% of the incident power, and the transmitted out of Port 2 is 31.7%. This results in 30.4% power absorption within the two port bifurcated guide of the system. Similarly, for a nominal 440 gauss static field, the reflected power at Port 1 is 77.7%, the transmitted power out of Port 2 is 7.2%. Therefore, 15.1% of the incident power is absorbed in the two port system. With a D.C. power supply feeding top and bottom electromagnets with a magnetic field of about 950 gauss, the transmitted power is −26 db down from the zero field case. All of the reflected power may be terminated in an attached isolator arm load (except for the small insertion loss in the two port switcher and the isolator).

It is noted that an isolator can be inserted between a power oscillator (typically a magnetron) connected to Port 1 of the two port device to absorb reflected power emerging from Port 1. This will protect the oscillator. It is also noted that a section of full waveguide (≈½ guide wavelength in length) can be placed between the isolator and the Port 1 to the two port device. This allows for evanescent decay of any excited higher order mode caused by out-of-phase fields (particularly the cutoff $TM_{11}$ rectangular guide mode).

The two-port switcher would be of interest in achieving pulse-to-pulse power changes where lower average power magnetrons are used or where there are space limitations. The embodiments hereinafter would be of interest in other applications.

3-Port Switcher

FIGS. 8-11 show another implementation of a microwave pulse power switching system in accordance with the invention. In this implementation, a three-port switcher, generally denoted by the numeral 60, is provided. This switcher is comprised of the two-port microwave pulse power switching system 11 identical to the two-port switching system described above, with the addition of a folded E-plane hybrid-T 61 ("folder-E hybrid") and a step transformer 63. The folded-E hybrid and step transformer are attached to what was Port 1 of the ferrite loaded bifurcated waveguide switching section 13 of the two port device, with the step transformer being placed between the folded-E hybrid and the port of the bifurcated waveguide switching section. The folded-E hybrid now provides two ports designated Port 1 and Port 3, with the opposite end of the bifurcation waveguide switching section being designated Port 2.

Figure 11:
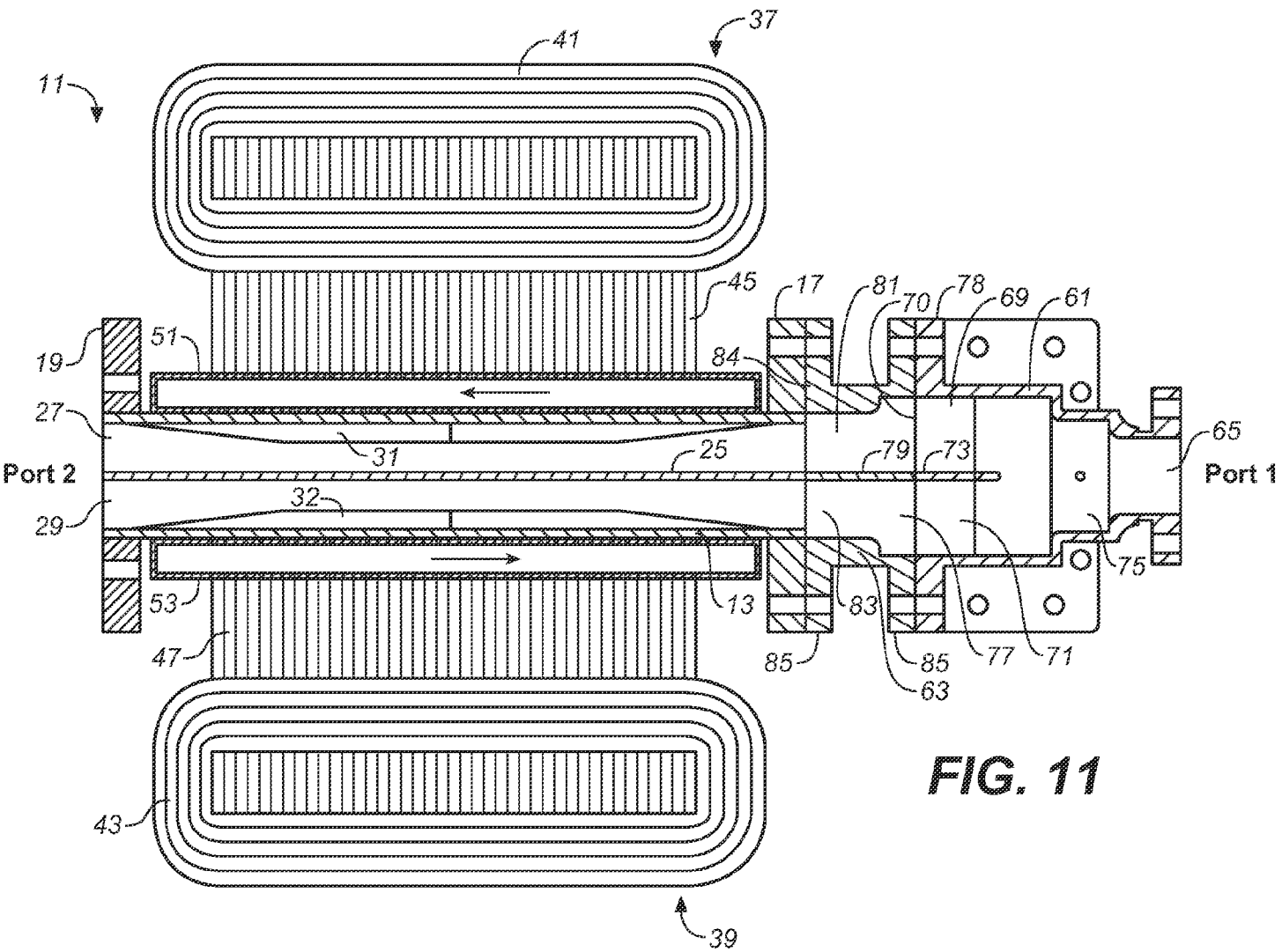
FIG. 11 is a cross-sectional view thereof taken along lines 11-11 in FIG. 10.
Figure 13:
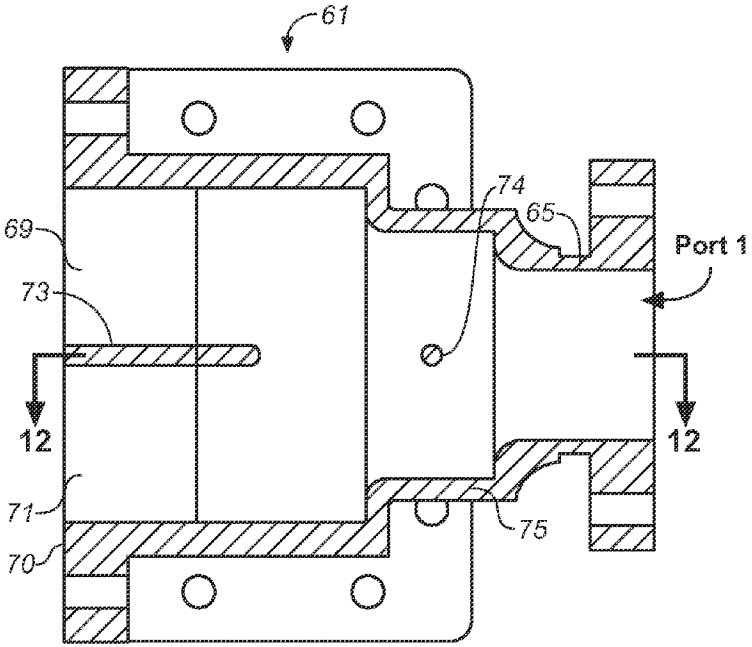
FIG. 13 is another cross-sectional view of the folded E-plane hybrid-T used in the three and four port versions of the illustrated microwave pulse power switching system of the invention, this time taken along lines 13-13 in FIG. 12.
Figure 12:
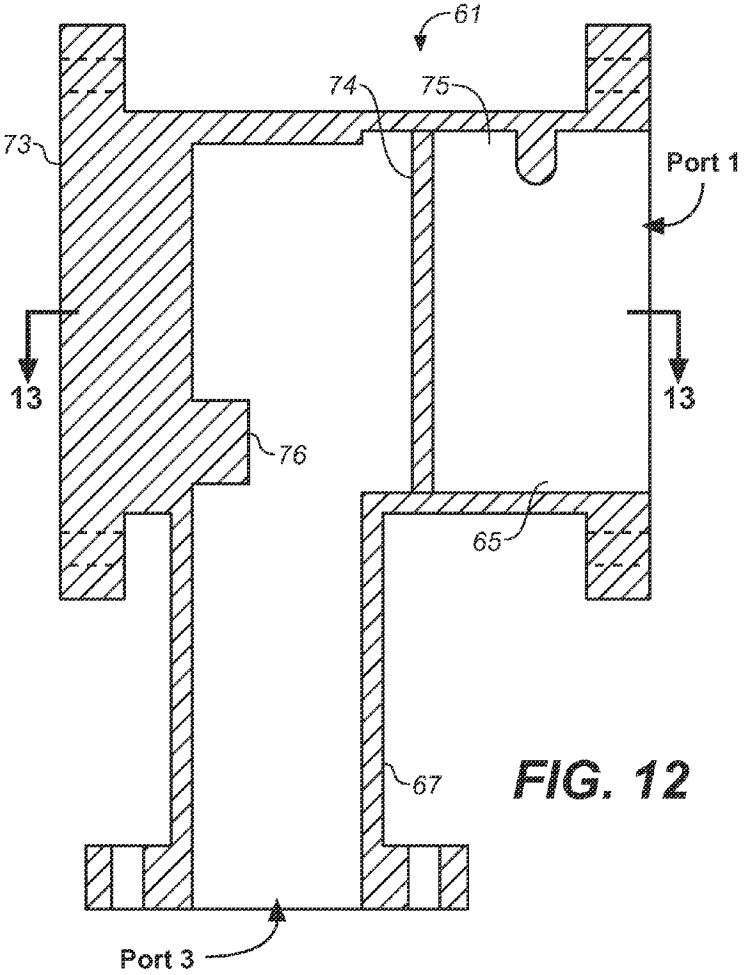
FIG. 12 is a cross-sectional view of the folded E-plane hybrid-T, taken along lines 12-12 in FIG. 13, that can be used in the three and four port versions of the illustrated microwave pulse power switching system of the invention.

FIG. 11 shows how the rectangular waveguide input at Port 1 of the folded-E hybrid transitions to the reduced height waveguides 27, 29 of the ferrite loaded bifurcated waveguide switching section 13; FIGS. 12 and 13 show in greater detail a folded-E hybrid that can be used with the 3-Port switcher.

Generally, the folded-E hybrid has a construction well-known in the art. As best shown in FIGS. 12 and 13, this type of hybrid waveguide coupler is seen to have a sum arm 65 (which is Port 1 of the three-port switcher), a difference arm 67, and a stacked waveguide end 70 comprised of dual stacked full height waveguides 69, 71 opposite the sum arm created by conductive center plate 73. The sum arm is followed by a step transition section 75, which transitions the sum arm to the dual stacked waveguides. (Internal conductive structures, such as post 74 and center projection 76 are provided impedance matching purposes.) The difference arm extends perpendicularly to the sum arm at a position between the dual stacked full height waveguides and the sum arm. Microwave power arriving at the dual stacked waveguides will couple to either the sum or difference arm of the hybrid depending on the relative phase of the microwave power: if in-phase it will couple to the sum arm; if out-of-phase it will couple to the difference arm.

In FIG. 11 it is seen that, in the three-port switcher, the stacked waveguide end 70 of the folded-E hybrid is attached to first enlarged end 77 of the step transformer 63. The conductive center plate 79 of the step transformer bifurcates the step transformer into upper and lower stacked waveguides 81, 83, the height of which are stepped down to a height that is slightly larger than the height of the upper and lower reduced height waveguides 27, 29 of the bifurcated waveguide switching section 13 of the two-port switcher section 11. This stepped-down height is presented at the second step-down end 84 of the step transformer, which is suitably about (or slightly less than) a quarter of a wavelength ahead of the step transition occurring at the junction of the step transformer and the bifurcated waveguide switching section. The mechanical attachments of these waveguide components can be made by conventional waveguide flanges, including flange 17 of the ferrite loaded bifurcated waveguide switching section 13, flanges 85 of the step transformer, and flange 78 of the folded-E hybrid.

The three-port switcher has advantages over the two-port device. If power is fed into the folded-E hybrid sum arm (Port 1), then power is transmitted from the folded-E hybrid into the full height ends of the step transformer's stacked waveguides 81, 83. These stacked waveguides feed into a stacked step transformer that matches into the two stacked reduced height waveguides of the ferrite loaded bifurcated waveguide switching section 13. Thus, with zero gauss field, power fed into Port 1 will arrive at Port 2. Since the top and bottom half-height guides have the same magnitude and phase (i.e.: zero phase difference), the power will be matched into a full height guide attached to Port 2 with only the one way insertion loss of the ferrite section. With applied "static" magnetic field and the resulting phase shift in the ferrite loaded upper and lower reduced height guides, the operation is altered from the two-port device. The transmission out of, and reflection back from, Port 2 remains identical to the two port device. However, when the reflections (top and bottom) arrive at the step transformer, they are conveyed on to the folded-E hybrid with additional phase difference. The hybrid sum arm (Port 1) will receive the resultant in-phase portion while the difference arm (Port 3) receives the out of phase portion. A waterload can be attached to Port 3 and an isolator to Port 1 to absorb these reflections.

The following results have been measured with a network analyzer for a three-port switcher as above-described using WR284 waveguide driven by an oscillator at 3.0 GHz in the presence of the indicated static magnetic field conditions in the upper and lower sections of the bifurcated guide:

| Magnetic Field (gauss) | 0 | ≈215 | ≈440 |
|---|---|---|---|
| $S_{11}$ (SWR) | 1.07 | 2.32 | −7.93 |
| $S_{21}$ (db) | −0.26 | −3.05 | −10.07 |
| $S_{12}$ (db) | −0.27 | −1.89 | −5.79 |
| $S_{22}$ (SWR) | 1.05 | 1.03 | 1.05 |
| $S_{31}$ (db) | −23.2 | −5.24 | −8.09 |

It is noted that $S_{22}$ is always well matched under various magnetic field conditions while $S_{21}$ can be varied from −0.26 db up to −10.7 db (or more). Reflected power at Port 1 is −0.1%, 15.8%, and 60.2% respectively. If sampling of forward and reflected power from a resonant cavity is positioned after Port 2, it would appear that resonant frequency tracking/monitoring of it would be reasonable. This is because $S_{22}$ is well matched.

In the 3 port switcher if pulse is fed into the bifurcated end of the switcher, that is, port 1 of the waveguide switching section becomes port 2 and vice versa, then the sum arm of the folded E plane hybrid becomes the output arm of the switcher. In this configuration, out-of-phase power arriving at port 3 of the switching system only requires a single transit from the input of the switcher. This would absorb less power in the ferrite loaded waveguide switcher section, but would increase the VSWR looking into the sum port as one increases the current through the coils of the electromagnet.

4-Port Switcher

Figure 14:
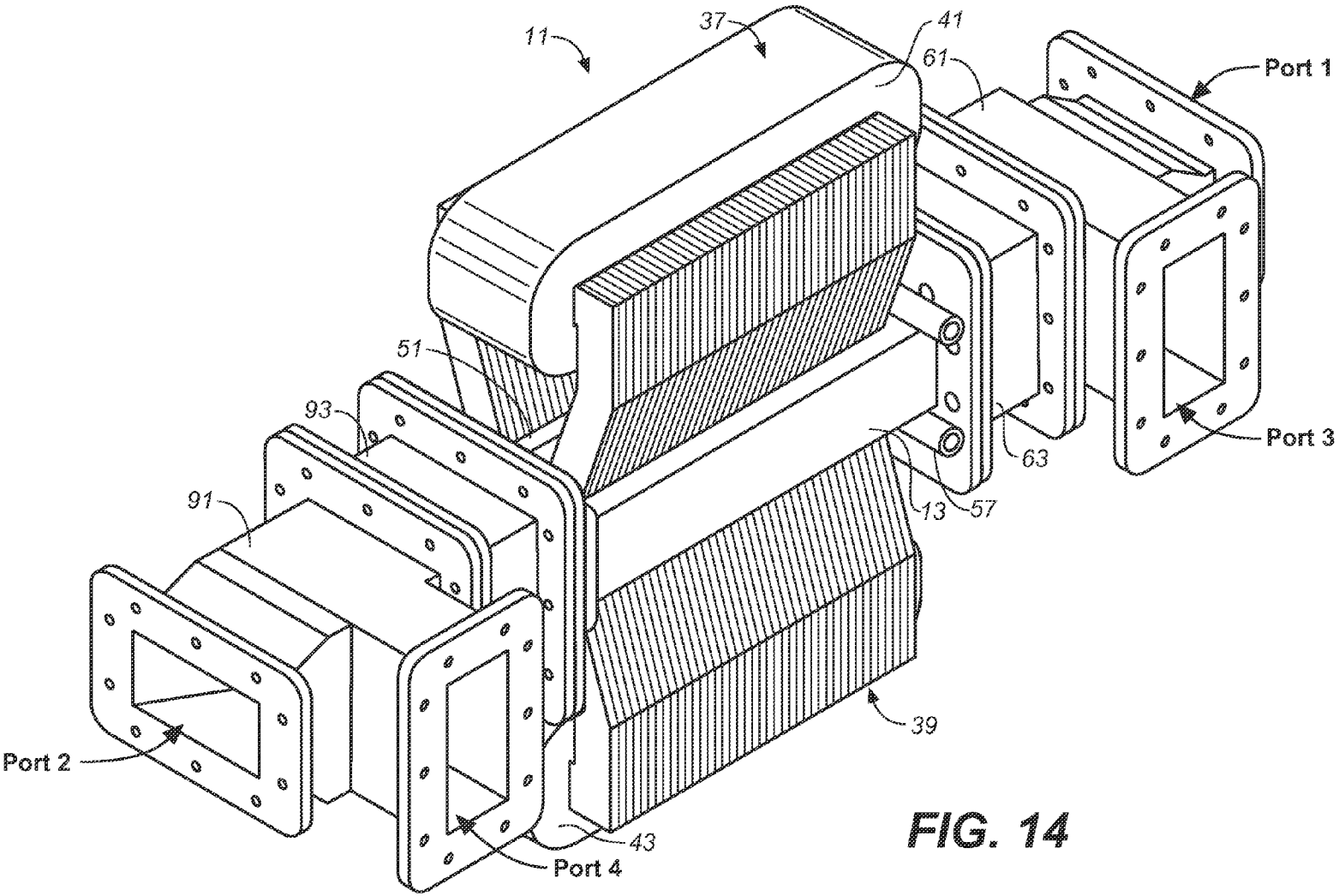
FIG. 14 is a top perspective view of a four-port version of a microwave pulse power switching system in accordance with the invention.
Figure 15:
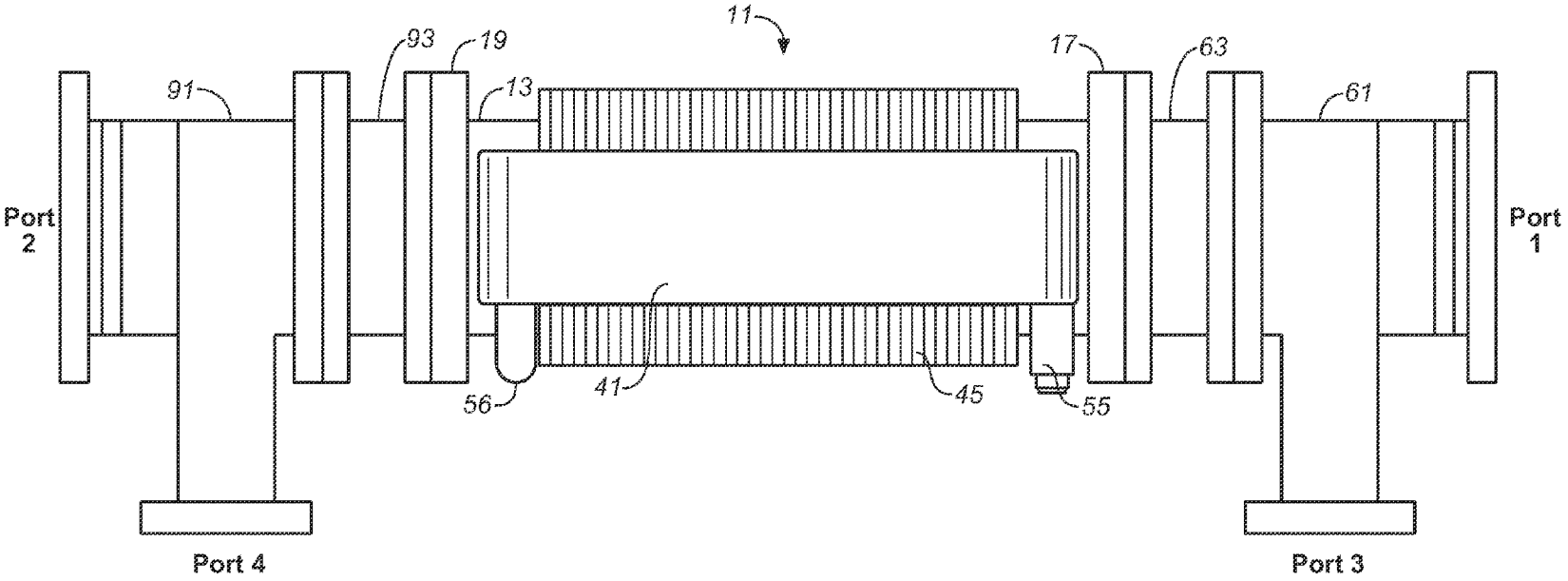
FIG. 15 is a top plan view thereof.

The four-port switcher is shown in FIGS. 14 and 15. This switcher is comprised of the two-port device 11 described above, with the addition of folded-E hybrid and step transformer at each end of ferrite loaded bifurcated waveguide switching section 13. A folded-E hybrid 61 and step transformer 63 are attached to what was Port 1 of the ferrite loaded bifurcated waveguide switching section 13 of the two port device as in the three-port switcher. The additional folded-E hybrid 91 and step transformer 93 are attached to what was Port 2 of the two port switcher. The folded-E hybrid 91 and step transformer 93 are attached in the same manner, with the step transformer being placed between the folded-E hybrid and the port of the bifurcated waveguide switching section. The folded-E hybrid 91 now provides two ports at the original Port 2 of the bifurcated waveguide switching section designated Port2 and Port 4, with the ports at the opposite end of the bifurcation waveguide switching section being designated Ports 1 and 3. With zero gauss field on the ferrite loaded waveguide switching section the performance will be equivalent to the Two and Three-Port ferrite devices described above.

The following is the predicted network analyzer measurements on four-port device:

| Magnetic Field (gauss) | 0 | ≈215 | ≈440 |
|---|---|---|---|
| $S_{11}$ (SWR) | <1.1 | <1.1 | <1.1 |
| $S_{21}$ (db) | ≈−0.3 | ≈−3.0 | ≈−10 |
| $S_{12}$ (db) | ≈−0.3 | ≈−3.0 | ≈−10 |
| $S_{22}$ (SWR) | <1.1 | <1.1 | <1.1 |
| $S_{31}$ (db) | ≈−23 | ≤−20 | ≤−20 |
| $S_{42}$ (db) | ≈−23 | ≤−20 | ≤−20 |

It will be appreciated that a four-port configuration can also be made using a side-x-side rectangular waveguide configuration using folded H-plane hybrids. Such a network would allow for higher power handling but would double the required magnet coil/stack laminate units. The size and number of components are increased over the stacked three-port in either four-port layout.

Magnetic Coil Excitation Techniques

The following describes useful method to obtain dynamic alternating of power levels at rep rates of interest from a waveguide pulse power switcher in accordance with the invention. The sequence would involve one full peak power pulse followed by a pulse at reduced selectable power in a repeating sequence.

Pulse power magnetrons for accelerator, pulse compression and some radar applications utilize pulse lengths on the order of four to five microseconds with repetition rates of 200-350 pulses per second. The duty factor (i.e.: time on/time off repetition) is usually on the order of 0.001. Of useful simplicity is the fact that all the above-described two, three and four port configurations use the same bifurcated ferrite loaded waveguide switching section 13 wherein the magnetic configuration is not polarization sensitive. That is, as long as the fields are correctly oriented for phase shift differential, it does not matter that one specific "half" guide leads or lags.

A 60 Hz, single phase voltage can be applied to the coils from a Variac (voltage transformer). A 60 Hz current passing through the coils 41, 43 of the two electromagnets 37, 39 will provide a magnetic field in the bifurcated waveguide switching section 13 that is zero two times per cycle and is maximum two times per cycle. Since the absolute direction of the magnetic phase, in time, is not important, two peak power conditions exist per 60 Hz period (i.e.: zero magnetic field) and two maximum (one plus and one minus) exist for reduced power from the switching network. The time period of 60 Hz is the inverse of the frequency and is equal to 16.67 milliseconds. For four, equally spaced pulses per cycle, the time interval is 4.167 milliseconds. Thus, one requires a short microwave pulse every 4.167 milliseconds, in step with the 60 Hz magnetic field as desired.

If a duty factor of 0.001 is allowed, (for a given magnetron) and a 60 Hz frequency is applied to the electromagnetic's coils, the magnetron rep rate is 4×60 or 240 pulses per second. The pulse length, $\tau$=D/f rep=0.001/240

$\tau$=4.16 microseconds

For 50 Hz (Europe)

$F_{rep}$=200

$\tau$=5 microseconds

Thus, 50 and 60 Hz, fit well into the allowable pulse lengths for existing high power pulsed magnetrons.

It has been demonstrated (with a low microwave power pulse source) that the firing of the 1$^{st}$ pulse can be synchronized with 60 Hz (or line) triggering with a total 4 pulse burst output per trigger generated. A Hewlett Packard 8112A pulse generator driving a mini-circuit ZYSW fast switch created 5 microsecond pulses spaced at 4.16 millisecond intervals. Output from the switcher illustrated the alternating power output (i.e.: full throughput, attenuated throughput, full throughput, attenuated throughput per each 60 Hz cycle, as desired). The level of the attenuation is increased by increasing voltage to the electromagnet's coils.

The above-described approach is not limited to 50 Hz or 60 Hz timing. Other sinusoidal frequencies above 60 Hz could be applied using AC generators or possibly pulse width modulation motor controller techniques. AC is preferable over square wave generators because of the higher frequency components in the latter. Higher frequencies require higher voltages to compensate for reduced skin depth in the conducting waveguide.

Cooling

One of the benefits of the distributed ferrite material used in the circulator's bifurcated waveguide switching section 13 is that the ferrite strips, which generate considerable heat in high-power applications, are more easily cooled than in conventional junction circulator designs. Referring to the drawings, a water cooling circuit for the ferrite material is provided in the form of upper and lower water cooling tubes 51, 53, running, respectively, along the upper and lower broadwalls 21, 22 of the bifurcated waveguide section 13. Each of the cooling tubes 51, 53 have a rectangular shape to maximize the contact surface area between the cooling tubes and the broadwalls of the guide. The upper and lower tubes are connected in a circuit by a connecting tube 56 at the end of the bifurcated waveguide behind waveguide flange 19. A suitable water input connector tube 55 and water outlet connector 57 are provided at the ends of the tubes behind flange 17.

It is noted that the length of the bifurcated waveguide switching section required to achieve sufficient phase shift of the microwave power from one end of the guide to the other can be shortened by increasing the thickness of the ferrite strips. On the other hand, an increase in the thickness of the ferrite strips will increase the cooling requirements for the switcher in high power applications. By keeping the ferrite strips relatively thin in a longer bifurcated waveguide switching section, the switcher can be used in higher power applications.

An S band three port microwave switcher as illustrated in FIGS. 7-11 has been built and operated successfully with a bifurcated waveguide switching section having a 9-inch long section of WR284 waveguide with nickel ferrite strips positioned as shown in FIG. 6 having a length of 8.3 inches (including the tapers), a width of one inch, and a thickness of 0.29 inches.

It will be appreciated that a number of variations of the preferred embodiments described and illustrated herein are possible within the scope of the invention. For example, while it is generally desirable to have the reduced height waveguides 27, 29 of the ferrite loaded waveguide switching section 13 the same height, the invention contemplates the possibility that the height of these guides could be different. In such an embodiment, however, it would not be possible to switch the pulse power to a full off condition.

It is also contemplated that the non-reciprocal ferrite material loading the reduced height waveguides of the bifurcated waveguide switching section 13 in the illustrated embodiments could be in the form of a distributed ferrite materials other than elongated ferrite strips. An example may be a series of short ferrite pieces distributed along the length of the guide.

Yet another contemplated embodiment of the invention would be to provide a bifurcated waveguide switching section in the form of separate stacked reduced height waveguides, as opposed to a single waveguide switching section bifurcated by a central web plate.

Still further, it would be possible to provide ferrite loading in only one of the stacked reduced-height waveguides of the bifurcated waveguide switching section as opposed to ferrite loading being provided in both reduced-height waveguides as described and illustrated herein. In such an embodiment, dielectric loading could suitably be provided in the other reduced height waveguide to maintain the same phase shift in both guides in zero magnetic field conditions.

It is yet further contemplated that the invention could be implemented using a bifurcated waveguide switching section having shapes other than a rectangular shape, for example, a round or elliptical shape.

It is understood that yet further embodiments of the present invention would be possible within the scope and spirit of the invention, and that it is not intended that the scope of the invention be limited by the detailed descriptions herein.

What I claim is:

1. A microwave pulse power switching system comprising a waveguide switching section having a first port and a second port, and having stacked reduced height waveguides which in combination form a full height waveguide having opposite sides, wherein microwave pulse power introduced into the first port of the waveguide switching section is divided between and propagates through said stacked reduced height waveguides, at least one of the stacked reduced height waveguides of said waveguide switching section being loaded with a non-reciprocal ferrite material, and a magnetic field switching circuit for producing a switchable static magnetic field in the at least one ferrite loaded reduced height waveguide of said waveguide switching section, said magnetic field switching circuit including at least one generally U-shaped electromagnet positioned on one side of the waveguide switching section against the at least one ferrite loaded reduced height waveguide such that the static magnetic field produced thereby passes through the ferrite material contained in the reduced height waveguide, wherein switching of the magnetic field switching circuit switches the static magnetic field in the at least one ferrite loaded reduced height waveguide to thereby cause a change in the phase relationship between the divided microwave pulse power that propagates down the different reduced height waveguides of said waveguide switching section, and wherein, by actuating said magnetic field switching circuit, the pulse power that emerges from the second port of said waveguide switching section can be changed relative to the pulse power introduced to the waveguide switching section.

2. The microwave pulse power switching system of claim 1 further comprising a step transformer coupled to the first port of said waveguide switching section and a folded hybrid-T coupled to said step transformer for providing a three port switching system.

3. The microwave pulse power switching system of claim 2 wherein said folded hybrid-T is a folded E-plane hybrid-T.

4. The microwave pulse power switching system of claim 1 further comprising a step transformer coupled to both the first and second ports of said waveguide switching section and folded hybrid-Ts coupled to each of said step transformers for providing a four port switching system.

5. The microwave pulse power switching system of claim 1 wherein the stacked reduced height waveguides of said waveguide switching section are formed by bifurcating a full height waveguide.

6. The microwave pulse power switching system of claim 1 wherein the stacked reduced height waveguides of said waveguide switching section are approximately one-half height waveguides.

7. The microwave pulse power switching system of claim 1 wherein both of the stacked reduced height waveguides of said waveguide switching section are loaded with a non-reciprocal ferrite material, wherein said magnetic field switching circuit produces a switchable static magnetic field that passes through the ferrite material contained in both of said stacked reduced height waveguides, and wherein switching on the static magnetic field in the ferrite loaded reduced height waveguides causes a change in the phase relationship between the divided microwave pulse power as it propagates down the reduced height waveguides of said waveguide switching section.

8. The microwave pulse power switching system of claim 1 wherein the ferrite material loading in the at least one reduced height waveguide of said waveguide switching section is distributed longitudinally along said reduced height waveguide.

9. The microwave pulse power switching system of claim 1 wherein said magnetic field switching circuit includes at least one switchable electromagnet.

10. The microwave pulse power switching system of claim 4 wherein said folded hybrid-Ts are folded E-plane hybrid-Ts.

11. A microwave pulse power switching system comprising a waveguide switching section having a first port and a second port, and having stacked reduced height waveguides which in combination form a full height waveguide having opposite broadwalls, wherein microwave pulse power introduced into the first port of the waveguide switching section is divided between and propagates through the stacked reduced height waveguides of the waveguide switching section, each of the stacked reduced height waveguides of said waveguide switching section being loaded with a non-reciprocal ferrite material that is distributed along a substantial portion of the length of the stacked reduced height waveguides, and a magnetic field switching circuit for producing a switchable static magnetic field in the ferrite loaded reduced height waveguides of said waveguide switching section, said magnetic field switching including separate generally U-shaped electromagnets, each U-shaped electromagnet being positioned against one of the broadwalls of the full height waveguide, such that the static magnetic field produced thereby passes through the ferrite material contained in the reduced height waveguide, wherein switching of the magnetic field switching circuit switches the static magnetic field in said ferrite loaded reduced height waveguides to thereby cause a change in the phase relationship between the divided microwave pulse power that propagates down the different reduced height rectangular waveguides of said waveguide switching section, and wherein, by actuating said magnetic field switching circuit, the pulse power that emerges from the second port of said waveguide switching section can be changed relative to the pulse power introduced to the first port of the waveguide switching section.

12. The microwave pulse power switching system of claim 11 wherein said magnetic field switching circuit includes electromagnets positioned on opposite sides of said waveguide switching section generally over the ferrite material loading the stacked reduced height waveguides.

13. The microwave pulse power switching system of claim 12 wherein said electromagnets include the laminated magnetic circuit blocks formed by thin plates of a material having high magnetic permeability.

14. The microwave pulse power switching system of claim 11 wherein said waveguide switching section is bifurcated into stacked reduced height waveguides by a transverse web plate extending longitudinally down said waveguide switching section and wherein said transverse web plate forms part of said magnetic field switching circuit.

15. The microwave pulse power switching system of claim 11 wherein the ferrite loaded stacked reduced height waveguides of said waveguide switching section are substantially symmetrical about all longitudinal mid-planes of the waveguide switching section.

16. A microwave pulse power switching system comprising a rectangular waveguide switching section having a first port and a second port and broadwalls having inner conductive surfaces, and further having a transverse web plate extending longitudinally down said waveguide substantially parallel to the broadwalls of the waveguide switching section to bifurcate said rectangular waveguide switching section into stacked reduced height rectangular waveguides, wherein microwave pulse power introduced into the first port of the waveguide switching section is divided between and propagates through the stacked reduced height rectangular waveguides of the waveguide switching section, each of the reduced height rectangular waveguides of said waveguide switching section being loaded with a non-reciprocal ferrite material distributed along a substantial portion of the length thereof, and a magnetic field switching circuit, which includes the web plate of said waveguide switching section, for producing a switchable static magnetic field in the ferrite loaded reduced height rectangular waveguides of said waveguide switching section, said magnetic field switching circuit including separate generally U-shaped electromagnets, each U-shaped electromagnet being positioned against one of the broadwalls of the waveguide section, such that the static magnetic field produced thereby passes through the ferrite material contained in the reduced height waveguide, wherein switching of the magnetic field switching circuit switches the static magnetic field in said ferrite loaded reduced height waveguides to thereby cause a change in the phase relationship between the divided microwave pulse power that propagates down the different reduced height waveguides of said waveguide switching section, and wherein, by actuating said magnetic field switching circuit, the pulse power that emerges from the second port of said waveguide switching section can be changed relative to the pulse power introduced to the waveguide switching section.

17. The microwave pulse power switching system of claim 16 wherein the ferrite material contained in said reduced height stacked rectangular waveguides are in the form of elongated ferrite strips affixed to the inner conductive walls of the broadwalls of the waveguide switching section, and wherein said electromagnets are positioned over the broadwalls of the waveguide switching section in opposition to said ferrite strips for producing a magnetic field between the electromagnets of the magnetic field switching circuit and the web plate of said waveguide that pass through said ferrite strips.

18. The microwave pulse power switching system of claim 17 wherein two ferrite strips are affixed to the inner conductive surface of each broadwall of said waveguide switching section, said ferrite strips being symmetrical located on either side of a center plane of said waveguide switching section, and wherein the electromagnet over each broadwall of said waveguide switching section includes a horseshoe-shaped magnetically permeable block having extended arms that are positioned over the two ferrite strips affixed to the inner conductive surface of the waveguide switching section.

19. The microwave pulse power switching system of claim 18 wherein said horseshoe-shaped magnetically permeable block is a laminated block formed by thin plates of a material having high magnetic permeability.

20. The microwave pulse power switching system of claim 18 wherein the ferrite strips of the reduced height rectangular waveguides of said waveguide switching section are positioned such that the ferrite loading is symmetrical about all center planes of the waveguide switching section.

* * * * *